US009653224B2

(12) United States Patent
Haugen et al.

(10) Patent No.: US 9,653,224 B2
(45) Date of Patent: May 16, 2017

(54) INTERRUPTION APPARATUS EMPLOYING ACTUATOR HAVING MOVABLE ENGAGEMENT ELEMENT

(71) Applicant: EATON CORPORATION, Cleveland, OH (US)

(72) Inventors: Jay Nicholson Haugen, Pittsburgh, PA (US); James Gerard Maloney, Industry, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/881,223

(22) Filed: Oct. 13, 2015

(65) Prior Publication Data

US 2017/0103860 A1 Apr. 13, 2017

(51) Int. Cl.

| | |
|---|---|
| ***H01H 75/00*** | (2006.01) |
| ***H01H 77/00*** | (2006.01) |
| ***H01H 3/38*** | (2006.01) |
| ***H01H 3/28*** | (2006.01) |
| ***H01H 9/10*** | (2006.01) |

(52) U.S. Cl.
CPC ..... *H01H 3/38* (2013.01); *H01H 3/28* (2013.01); *H01H 9/102* (2013.01)

(58) Field of Classification Search
CPC ..... H01H 71/1009
USPC ..... 335/8
See application file for complete search history.

(56) References Cited

U.S. PATENT DOCUMENTS 3,280,282 A * 10/1966 Rodeseike ..... H01H 9/10 200/50.21
3,411,038 A * 11/1968 Lee ..... H01H 33/66 218/140
3,806,680 A * 4/1974 Link ..... H01H 85/047 218/126
3,909,765 A * 9/1975 Link ..... H01H 85/36 218/118
4,478,347 A * 10/1984 Cherry ..... H01H 33/66207 218/136
4,692,733 A * 9/1987 Oakes ..... H01H 85/047 218/1
4,831,347 A * 5/1989 Orosz ..... H01H 9/345 335/10
5,258,729 A * 11/1993 Link ..... H01H 71/0228 335/132
5,686,709 A * 11/1997 Casagrande ..... H01H 71/1009 200/50.32
6,362,445 B1 * 3/2002 Marchand ..... H02B 13/0354 218/155
6,930,271 B1 * 8/2005 Palmieri ..... H01H 33/6662 218/119

(Continued)

*Primary Examiner* — Alexander Talpalatski
(74) *Attorney, Agent, or Firm* — Eckert Seamans; Brij Agarwal; Grant Coffield

(57) ABSTRACT

An improved interruption apparatus includes a plurality of poles, with each of the poles including an actuator. In one embodiment, the actuator can be a fuse having a movable engagement element, and in another embodiment the actuator can be an electric coil that is operable to move a movable engagement element. The interruption apparatus has a single trip unit, and the engagement element of any actuator can actuate the trip unit to move all of the poles from a CLOSED state to an OPEN state.

4 Claims, 4 Drawing Sheets

(56) References Cited

U.S. PATENT DOCUMENTS

| | | | | |
|---|---|---|---|---|
| 7,239,490 | B2 * | 7/2007 | Benke | H01H 33/666<br>218/118 |
| 8,729,416 | B2 * | 5/2014 | Bullock | H01H 33/6662<br>218/118 |
| 8,729,985 | B2 * | 5/2014 | Bullock | H01H 33/6662<br>335/119 |
| 2005/0139579 | A1 * | 6/2005 | Sakamoto | H01H 3/46<br>218/118 |
| 2011/0046808 | A1 * | 2/2011 | Kellis | H01H 47/002<br>700/293 |
| 2015/0332883 | A1 * | 11/2015 | Benke | H01H 71/125<br>335/9 |

* cited by examiner

INTERRUPTION APPARATUS EMPLOYING ACTUATOR HAVING MOVABLE ENGAGEMENT ELEMENT

BACKGROUND

Field

The disclosed and claimed concept relates generally to electrical interruption equipment and, more particularly, to an interruption apparatus that employs an actuator having a movable engagement element.

Related Art

Numerous types of circuit interruption devices are known in the relevant art and include circuit breakers, vacuum interrupters, and numerous other devices that interrupt a circuit. While such devices have been generally effective for their intended purposes, they have not been without limitation.

As is generally understood, a circuit interruption device typically includes a conductor having a set of separable contacts within it, and the conductor forms a part of a circuit. When the separable contacts are electrically connected together, the circuit is in a CLOSED state, and when the contacts are electrically separated from one another, the circuit is in OPEN state. A circuit breaker or other interrupter typically also includes some type of trip unit that employs stored spring energy which is rapidly released to move the separable contacts apart in response to an overcurrent condition or an under-voltage condition or other appropriate condition.

However, as the needs of a given circuit or set of circuits become more complex, the cost of the equipment used to protect such circuitry correspondingly increases. Improvements thus would be desired.

SUMMARY

An improved interruption apparatus includes a plurality of poles, with each of the poles including an actuator. In one embodiment, the actuator can be a fuse having a movable engagement element, and in another embodiment the actuator can be an electric coil that is operable to move a movable engagement element. The interruption apparatus has a single trip unit, and the engagement element of any actuator can actuate the trip unit to move all of the poles from a CLOSED state to an OPEN state.

Accordingly, an aspect of the disclosed and claimed concept is to provide an improved interruption apparatus having a plurality of poles, with each pole having its own actuator, and with the interruption apparatus having a single trip unit that is actuatable by any one of the actuators to open all of the poles.

Another aspect of the disclosed and claimed concept is to provide an improved multi-pole interruption apparatus at a reduced cost.

Another aspect of the disclosed and claimed concept is to provide an improved multi-pole interruption apparatus having reduced mechanical complexity.

Accordingly, an aspect of the disclosed and claimed concept is to provide an improved interruption apparatus that can be generally stated as including a plurality of conductors, a contact arm apparatus that can be generally stated as including a plurality of contact arms, a contact apparatus that can be generally stated as including a plurality of sets of separable contacts, each set of separable contacts of the plurality of sets of separable contacts comprising a movable contact and a stationary contact, the movable contact being situated on a corresponding contact arm of the plurality of contact arms, the stationary contact being electrically connected with a first portion of a corresponding conductor of the plurality of conductors and the movable contact being electrically connected with a second portion of the corresponding conductor, a trip unit that is operably connected with each contact arm of the plurality of contact arms, the trip unit being movable between an ON condition wherein the plurality of contact arms are positioned such that the plurality of sets of separable contacts are each in a CLOSED state and an OFF condition wherein the plurality of contact arms are positioned such that the plurality of sets of separable contacts are each in an OPEN state, a plurality of actuators, each actuator of the plurality of actuators being electrically connected with a corresponding conductor of the plurality of conductors, each actuator of the plurality of actuators can be generally stated as including a support, a detector, and an engagement element, the engagement element being situated on the support and being movable between a first position with respect to the support and a second position with respect to the support, the first position and the second position being different than one another, the engagement element in one of the first position and the second position being engageable with the operating mechanism when the operating mechanism is in the ON condition and, responsive to a detector of an actuator of the plurality of actuators experiencing a predetermined event, the corresponding engagement element moving from the first position toward the second position and undergoing a change in its state of engagement with the operating mechanism by becoming one of engaged with the operating mechanism and disengaged with the operating mechanism and thereby triggering the trip unit to release the operating mechanism to move from the ON condition to the OFF condition.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
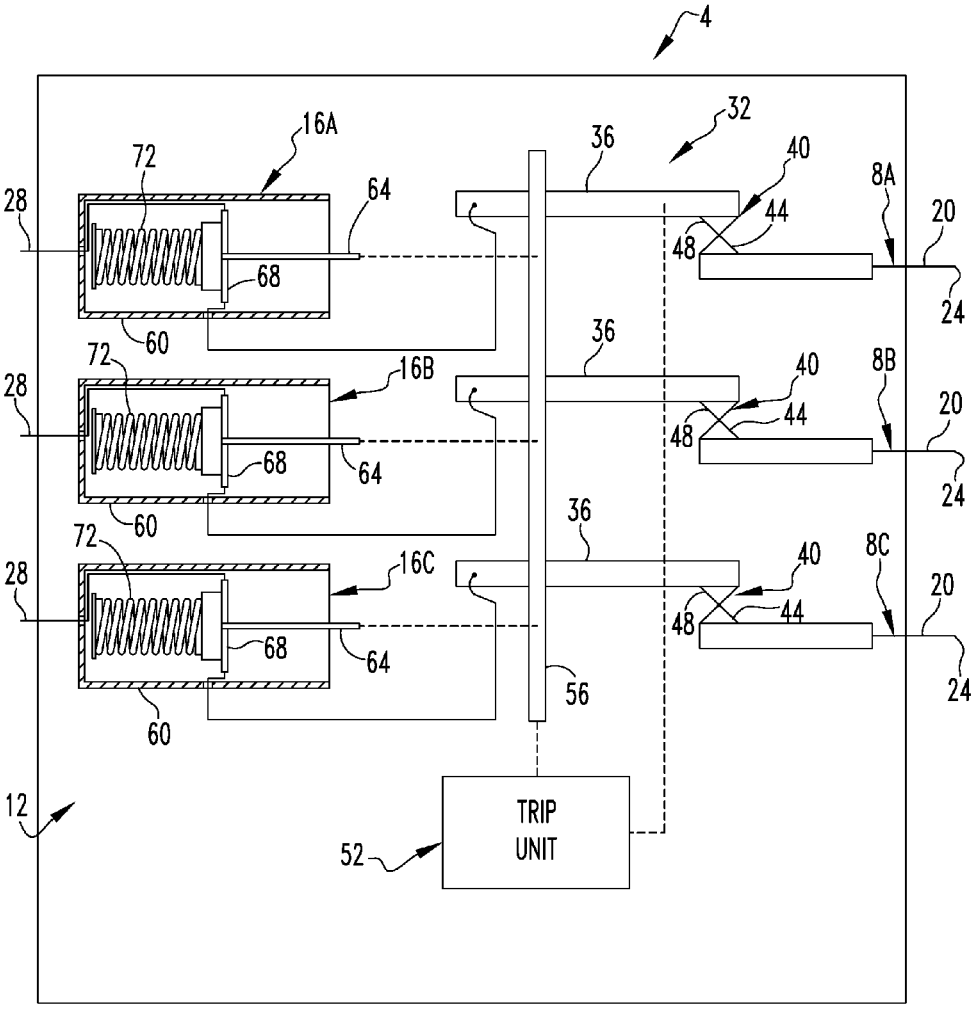
FIG. 1 is a schematic depiction of an improved interruption apparatus in accordance with a first embodiment of the disclosed and claimed concept.

An improved interruption apparatus 4 in accordance with the disclosed and claimed concept is depicted schematically in FIG. 1. The interruption apparatus 4 is an electrical interruption apparatus that includes a plurality of poles that are indicated at the numerals 8A, 8B, and 8C, it being noted that such poles may be individually or collectively referred to herein with the numeral 8. The poles 8 are electrically separate from one another. While the interruption apparatus 4 is depicted herein as including three of the poles 8, it is understood that in other embodiments the interruption apparatus 4 can include two poles or more than three poles without departing from the present concept. As will be set forth in greater detail below, the interruption apparatus 4 is capable of being manufactured in a cost advantageous fashion because it employs inexpensive devices to detect the conditions on each pole 8, and any of these inexpensive devices can actuate a single mechanism that moves all of the poles from the CLOSED state to the OPEN state to thereby move the interruption apparatus 4 from an ON condition to an OFF condition.

The interruption apparatus 4 includes an actuator apparatus 12 that includes a plurality of actuators that are indicated at the numerals 16A, 16B, and 16C, it being noted that the actuators can be individually or collectively referred to herein with the numeral 16. A corresponding one of the actuators 16 is provided for each pole 8, and the actuators 16 are thus three in quantity. As will be set forth in greater detail below, the exemplary actuators 16 are each in the exemplary form of a fuse.

As can be further seen in FIG. 1, each pole 8 includes a conductor 20 that can be said to include a line end 24 and a load end 28 opposite one another that are connectable with a circuit to provide protection for the circuit. The poles 8 are depicted in FIG. 1 as each being in a CLOSED state, meaning that each pole 8 is electrically conductive between the line and load ends 24 and 28.

The interruption apparatus 4 further includes a contact arm apparatus 32 that includes a plurality of contact arms 36, with each pole 8 including its own corresponding contact arm 36. Each pole 8 further includes a set of separable contacts 40. Each set of separable contacts 40 includes a stationary contact 44 and a movable contact 48. The movable contact 48 is affixed to the corresponding contact arm 36 of the pole 8, and the stationary contact 44 is affixed to another portion of the corresponding conductor 20 of the pole 8. The stationary and movable contacts 44 and 48 can be of any form, including blade and socket disconnect-type elements and the like, without departing from the present concept. Each set of separable contacts 40 is depicted in FIG. 1 as being in an electrically connected condition but are depicted elsewhere herein, such as in FIG. 4C, in an electrically disconnected condition.

The interruption apparatus 4 further includes a single trip unit 52 that includes a trip cam 56 which is operably associated with each of the poles 8. The trip unit 52 includes one or more springs that are used to store mechanical energy and further includes a latch that is operable to rapidly release the stored mechanical energy to separate the sets of separable contacts 40.

Figure 4A:
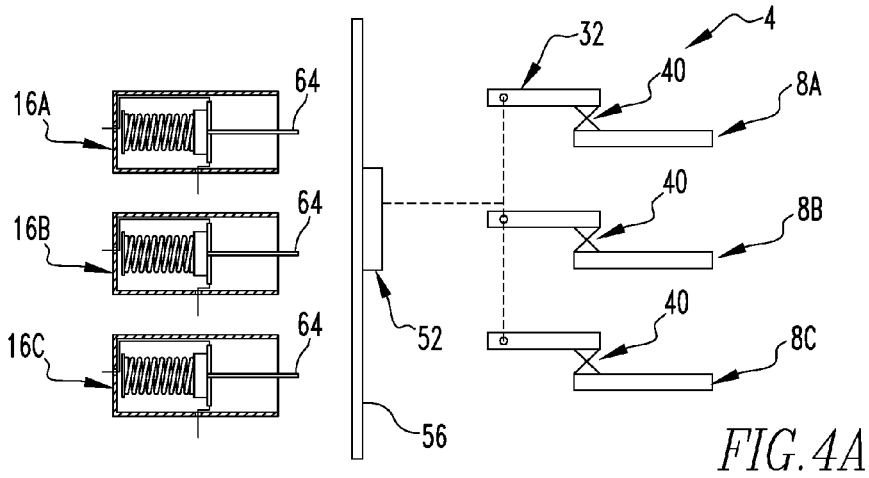
FIG. 4A is diagrammatic depiction of the interruption apparatus of FIG. 1 in an ON condition
Figure 4B:
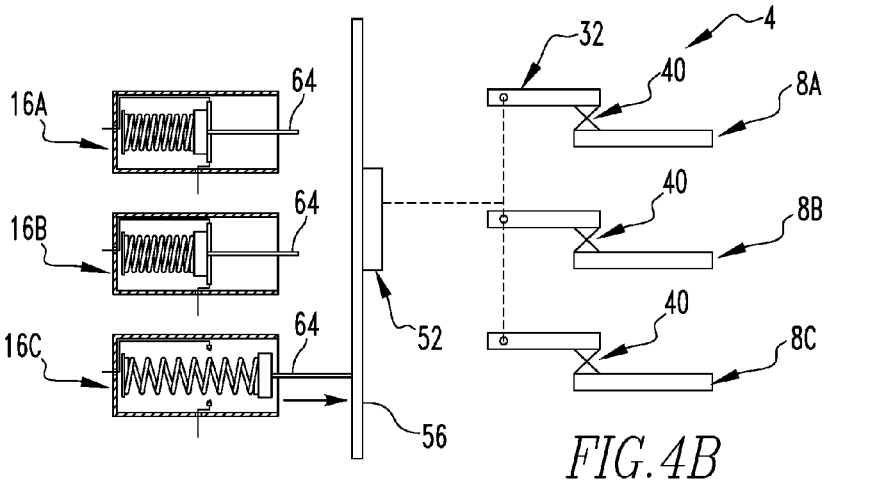
FIG. 4B is a view similar to FIG. 4A, except depicting an actuator having moved from the first state to the second state.
Figure 4C:
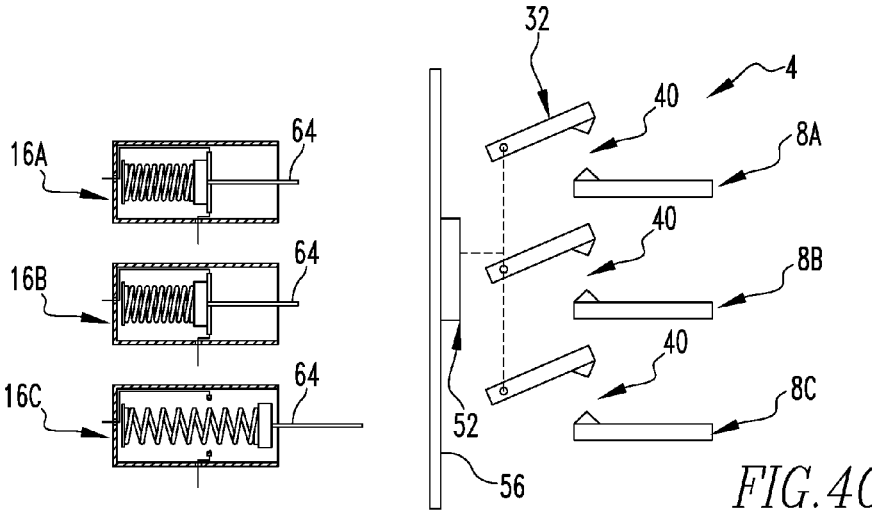
FIG. 4C is a view similar to FIG. 4B, except depicting the interruption apparatus in an OFF condition.

As will be set forth in greater detail, when the trip cam 56 is engaged or otherwise actuated by any of the actuators 16A, 16B, and 16C, the trip cam 56 triggers the trip unit 52 to move all of the contact arms 36 of the contact arm apparatus 32 to thereby move the sets of separable contacts 40 from the electrically connected condition of FIGS. 1 and 4A to an electrically disconnected condition, such as is depicted in FIG. 4C. In the exemplary embodiment presented herein, the trip cam 56 does so by releasing the latch of the trip unit 52 which rapidly releases the stored spring energy in the trip unit 52 to move the contact arms 36. It is understood, however, that the specific configuration of the trip unit 52 that is described herein is exemplary in nature and is not intended to be limiting.

Figure 2:
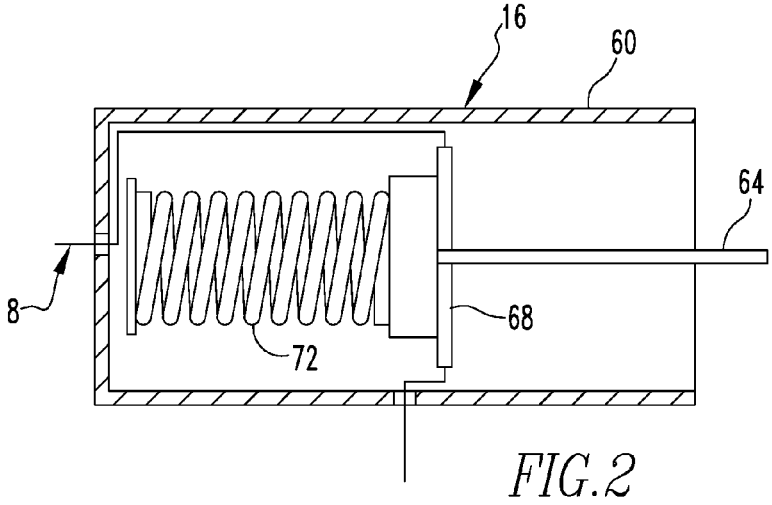
FIG. 2 is a depiction of an actuator of the interruption apparatus of FIG. 1 in a first state.
Figure 3:
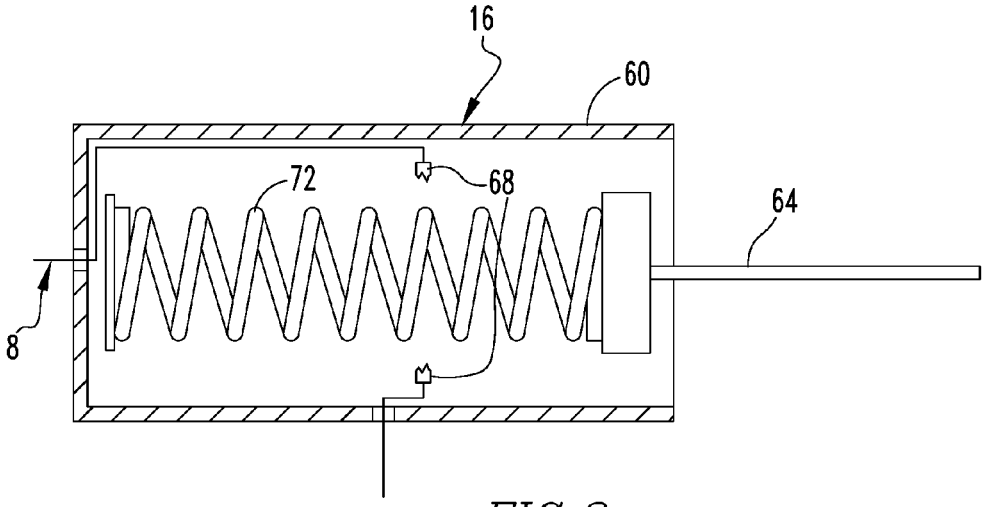
FIG. 3 is a view similar to FIG. 2, except depicting the actuator in a second state.

As can be seen in FIGS. 2 and 3, the actuators 16 each include a support 60 and a movable engagement element 64. The engagement element 64 is situated on the support 60 and is movable with respect to the support 60 between a retracted state, such as is depicted generally in FIG. 2, and an extended state such as is depicted generally in FIG. 3. Each actuator 16 further includes a fusible element 68 that functions as a detector which, upon experiencing a predetermined overcurrent or other condition on its associated pole 8, undergoes a deformation such as by melting or otherwise fusing. The actuators 16 further each include a spring 72 that serves as a biasing element that biases the engagement element 64 toward the extended state.

The exemplary fusible element 68 is depicted in FIG. 2 in an intact, i.e., unfused, condition wherein it retains the engagement element 64 in the retracted state and thus overcomes the bias of the spring 72. The fusible element 68 is depicted in FIG. 3 as having experienced a predetermined overcurrent condition or other condition and as having undergone deformation, such as by melting or fusing and thereby releasing the bias of the spring 72. This permits the spring 72 to move the engagement element 64 from the retracted state of FIG. 2 to the extended state of FIG. 3. It is understood that the exemplary depiction of the actuator 16 in FIGS. 2 and 3 is meant to be functional only and not limiting as to the particular configuration of the actuators 16. Rather, the actuators 16 can be in any of a variety of configurations that cause the engagement element 64 to move between two states or positions when a detector experiences a predetermined condition on the associated pole 8.

As can be seen in FIG. 1, the actuators 16A, 16B, and 16C are each electrically connected with the corresponding conductor 20 of the poles 8A, 8B, and 8C, respectively. While the actuators 16 are each depicted in FIG. 1 in an exemplary fashion as being connected in series with other conductive components of the corresponding conductors 20, it is understood that the actuators 16 could be otherwise connected with the conductors 20 while still detecting overcurrent conditions or other conditions on each of the poles 8 without departing from the present concept.

The ON condition of the interruption apparatus 4 that is depicted in FIG. 1 is also diagrammatically depicted in FIG. 4A. When any of the actuators 16 detects or otherwise experiences a predetermined condition such as an overcurrent condition or other condition on its associated pole 8, the corresponding engagement element 64 is released to move from its retracted state to its extended state. More specifically, FIG. 4B depicts the actuator 16C as having its fusible element 68 in a fused or otherwise deformed state responsive to having experienced the overcurrent or other condition on the pole 8C, thereby releasing the corresponding engagement element 64 to be biased by the spring 72 from the retracted state of FIG. 4A to the extended state of 4B where the engagement element 64 has engaged the trip cam 56.

In FIG. 4C, the trip cam 56 that has been engaged by the engagement element 64 of the actuator 16C has released the latch of the trip unit 52 to cause the trip unit 52 to move the contact arms 36 and thus the movable contacts 48 situated thereon to all be electrically disconnected from the associated stationary contacts 44. As such, FIG. 4C depicts each of the poles 8 as being in the OPEN state such that the interruption apparatus 4 is in the OFF condition. While the actuator 16C is depicted in FIGS. 4B and 4C as having experienced an overcurrent or other predetermined condition on the pole 8C and thus having released its engagement element 64 to engage the trip cam 56 to thereby move all of the poles 8 to the OPEN state, it is noted that any one of the actuators 16A, 16B, and 16C could individually engage the trip cam 56 to simultaneously move all of the poles 8 to the OPEN state.

It thus can be seen that the actuators 16A, 16B, and 16C are each separately responsive to an overcurrent condition or other appropriate condition on the associated pole 8A, 8B, and 8C, respectively. Accordingly, any one of the actuators 16A, 16B, and 16C that may experience such an overcurrent condition or other predetermined condition can individually engage the trip cam 56 which, in turn, causes the trip unit 52 to open all of the poles 8, and this is by operation of only the individual trip unit 52.

Employing the individual trip unit 52 to simultaneously operate all three of the poles 8 saves expense by avoiding the need to provide a separate trip unit for each pole 8. Rather, separate actuators 16A, 16B, and 16C are provided for each of the poles 8. The actuators 16 are each individually operable in response to a predetermined condition occurring on its associated pole 8 to engage the trip cam 56 to actuate the individual trip unit 52 to move all of the poles 8 to the OPEN state to move the interruption apparatus to the OFF condition. That is, the use of multiple inexpensive and replaceable actuators 16 and only a single trip unit 52 is advantageously less expensive than providing a separate trip unit 52 for each pole 8, which saves expense, and which is thus desirable.

Figure 5:
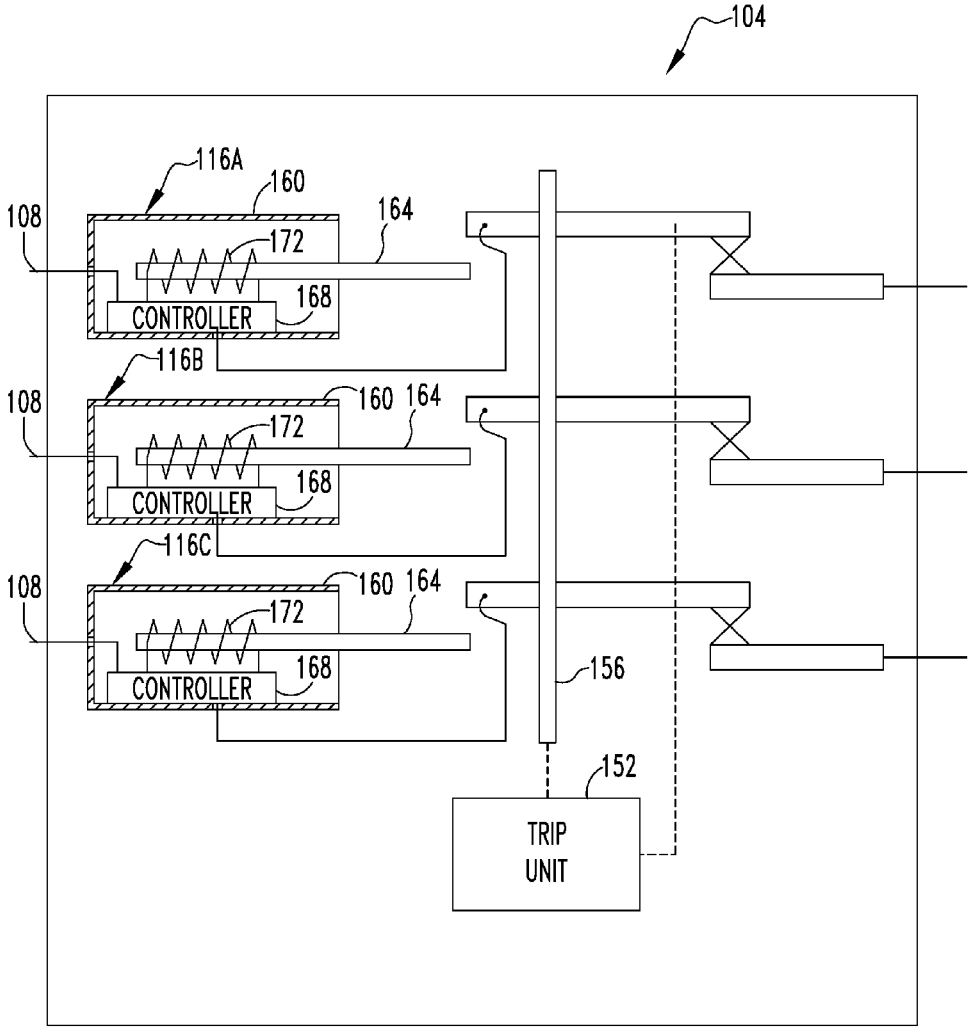
FIG. 5 is a schematic depiction of an improved interruption apparatus in accordance with a second embodiment of the disclosed and claimed concept.

An improved interruption apparatus 104 in accordance with a second embodiment of the disclosed and claimed concept is depicted in a schematic fashion in FIG. 5. The interruption apparatus 104 is similar to the interruption apparatus 4, except that the interruption apparatus 104 employs a different actuator apparatus having a plurality of actuators 116A, 116B, and 116C. It is noted that the actuators may be individually or collectively referred to herein with the numeral 116.

The actuators 116 each include a support 160 and a movable engagement 164 that is movable with respect to the support 160 between a retracted state and an extended state, such as is provided by the actuators 16. It is noted, however, that each support 160 employs a controller 168 that is connected with a corresponding electrical coil 172. In the depicted exemplary embodiment, the controller 168 is electrically connected with its associated pole 108 and, in response to experiencing a predetermined overcurrent or other condition on the pole 108, energizes the coil 172. The energized coil 172 causes the engagement element 164 to move from the retracted state of FIG. 5 to the extended state that is depicted in dashed lines in FIG. 5. As before, any one of the engagement elements 164 can individually engage a trip cam 156 of the interruption apparatus 104 that will trigger an individual trip unit 152 to move the plurality of contact arms of the interruption apparatus 104 to move all of the poles 108 to the OPEN state.

While the controllers 168 are depicted in FIG. 5 as each being electrically connected with an associated pole 108 and being operable to energize the associated coil 172, it is noted that in other embodiments controllers 168 may be otherwise configured or may be entirely absent. That is, the coil 172 may itself be electrically connected with the associated pole 108 depending upon the needed configuration.

Since the controller 168 and the coil 172 serve as a detector and do not permanently deform by fusing, the engagement element 164 can be reset to the retracted state. As such, the controller 168 and the coil 172 can again be used to detect a predetermined condition on its associated pole 108 and responsively move the associated engagement element 164 from the retracted state to the extended state. Any one of the actuators 116 is individually operable to move its associated engagement element 164 to the extended state to thereby engage the trip cam 156 and cause the trip unit 152 to move all of the poles 108 to the OPEN state, in a fashion similar to the interruption apparatus 104. Other variations of the concept presented herein will be apparent to one of ordinary skill in the art.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An interruption apparatus comprising:

a plurality of conductors;

a contact arm apparatus comprising a plurality of contact arms;

a contact apparatus comprising a plurality of sets of separable contacts, each set of separable contacts of the plurality of sets of separable contacts comprising a movable contact and a stationary contact, the movable contact being situated on a corresponding contact arm of the plurality of contact arms, the stationary contact being electrically connected with a first portion of a corresponding conductor of the plurality of conductors and the movable contact being electrically connected with a second portion of the corresponding conductor;

a trip unit that is operably connected with each contact arm of the plurality of contact arms, the trip unit being movable between an ON condition wherein the plurality of contact arms are positioned such that the plurality of sets of separable contacts are each in a CLOSED state and an OFF condition wherein the plurality of contact arms are positioned such that the plurality of sets of separable contacts are each in an OPEN state;

a plurality of actuators, each actuator of the plurality of actuators being electrically connected with a corresponding conductor of the plurality of conductors, each actuator of the plurality of actuators comprising a support, a detector, and an engagement element, the engagement element being situated on the support and being movable between a first position with respect to the support and a second position with respect to the support, the first position and the second position being different than one another, the engagement element in one of the first position and the second position being engageable with the operating mechanism when the operating mechanism is in the ON condition, responsive to the detector experiencing a predetermined event, the engagement element moving from the first position toward the second position and undergoing a change in its state of engagement with the operating mechanism by becoming one of engaged with the operating mechanism and disengaged from the operating mechanism; and responsive to fewer than all of the engagement elements undergoing the change in state of engagement with the operating mechanism, the trip unit becoming thereby triggered to release the operating mechanism to move from the ON condition to the OFF condition.

2. The interruption apparatus of claim 1 wherein the plurality of actuators comprise a plurality of fuses each having as the detector a fusible element which, responsive to a predetermined event, is structured to undergo an at least partial deformation to cause the engagement element to move from the first position toward the second position.

3. The interruption apparatus of claim 2 wherein the support comprises a biasing element that biases the engagement element toward the second position, and wherein the at least partial deformation permits the biasing element to move the engagement element toward the second position.

4. The interruption apparatus of claim 1 wherein the plurality of actuators comprise a plurality of electrical actuators each having as the detector a coil that is electrically connected with a corresponding conductor of the plurality of conductors and which, responsive to a predetermined event, is structured to magnetically bias the engagement element to move from the first position toward the second position.

* * * * *